United States Patent [19]

Konrath

[11] 4,168,940

[45] Sep. 25, 1979

[54] FUEL INJECTION PUMP

[75] Inventor: Karl Konrath, Ludwigsburg, Fed. Rep. of Germany

[73] Assignee: Robert Bosch GmbH, Stuttgart, Fed. Rep. of Germany

[21] Appl. No.: 839,674

[22] Filed: Oct. 5, 1977

[30] Foreign Application Priority Data

Oct. 28, 1976 [DE] Fed. Rep. of Germany ..... 2648991

[51] Int. Cl.[2] ..... F04B 49/00

[52] U.S. Cl. ..... 417/296; 123/139 AQ

[58] Field of Search ..... 417/289, 296, 492–494, 417/499, 500; 123/139 AD, 139 AE, 139 AQ, 137 BD

[56] References Cited

U.S. PATENT DOCUMENTS

| | | | |
|---|---|---|---|
| 3,635,603 | 1/1972 | Eheim | 417/289 X |
| 3,906,916 | 9/1975 | Laufer | 123/139 AQ |
| 3,910,724 | 10/1975 | Okamoto | 417/289 X |
| 3,942,914 | 3/1976 | Hofer et al. | 417/289 |
| 3,945,360 | 3/1976 | Laufer | 417/289 X |
| 4,036,193 | 7/1977 | Kobayashi et al. | 417/289 X |

FOREIGN PATENT DOCUMENTS

| | | | |
|---|---|---|---|
| 889272 | 1/1944 | France | 123/139 AQ |

*Primary Examiner*—William L. Freeh
*Assistant Examiner*—Edward Look
*Attorney, Agent, or Firm*—Edwin E. Greigg

[57] ABSTRACT

A fuel injection pump for delivery of fuel under high pressure to combustion chambers and in which the fuel is delivered by a rotating and reciprocating pump piston. The relative angular position of the pump piston with respect to its drive shaft defines the timing of fuel injection. This timing is varied in accordance with engine speed by a hydraulic servo-mechanism which includes a piston moving against two springs, one of which comes into engagement before the other so that the change of injection timing as a function of engine speed follows two different curves.

5 Claims, 3 Drawing Figures

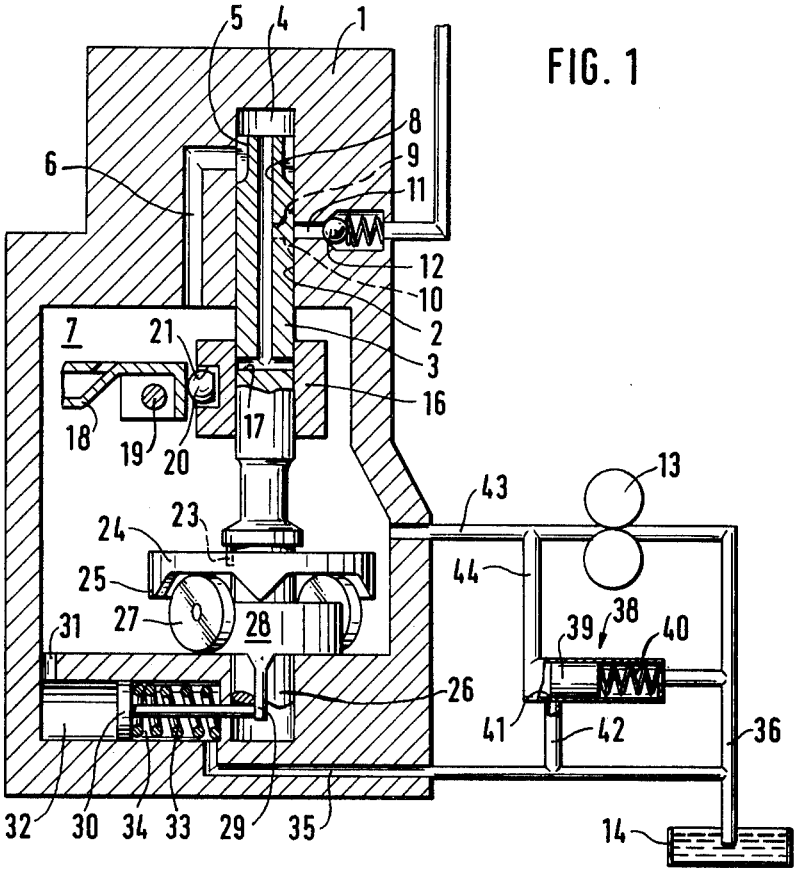
FIG. 1
FIG. 2
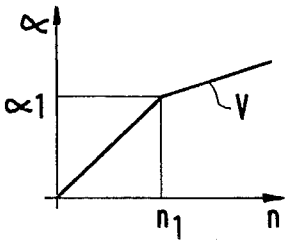
FIG. 3
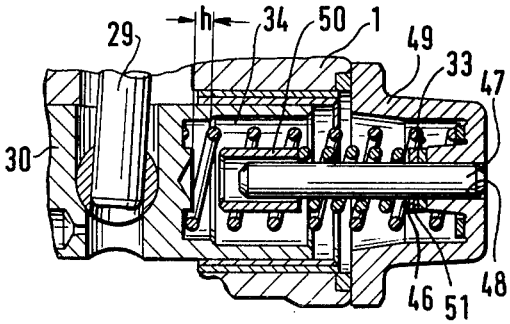

FUEL INJECTION PUMP

BACKGROUND OF THE INVENTION

It is common knowledge that in a Diesel engine injection of the fuel occurs when the piston of a given engine is in the zone of top dead center (TDC). The initial injection is timed to occur from slightly before TDC to shortly after TDC, dependent upon engine speed; in general, injection occurs at an earlier point at a higher rpm than at a lower rpm. Though the time period required for fuel to be fed from the pump to the jet is largely constant and independent of the rpm level, the time period between fuel pump output and its combustion in the engine varies corresponding to the rpm level.

This variation in the cycle of injection timing is compensated for by means of an injection timing adjustment. Though the primary task of the adjustment device is injection timing modulation, the residual capacity of the device serves, dependent upon the combustion requirements of a given engine, to improve the fuel consumption, the HP and torque output, the smoothness of operation, and/or the exhaust gas quality. For example, when the injection timing is closely matched to the desired exhaust gas compositions, in order to decrease polluting by-products of combustion, then it is necessary to decrease the degree of advancement in the injection timing cycle at an rpm above the middle rpm range of a given engine, in order to prevent excessive roughness in the operation of the engine.

A known fuel injection pump has at least one pump piston powered by a cam drive assembly which is rotatable for the purpose of injection timing adjustment. The rotation is imparted by a servo mechanism subject to rpm-dependent hydraulic pressure and against the force of two separate return springs acting in parallel.

The use of two springs makes it possible, for a first approximation, to decrease the slope of the characteristic curve in the upper rpm domain, i.e., that curve which describes the injection angle as a function of engine speed.

The injection timing is thus set primarily to attain the desired emission characteristics of the engine. This setting leads, however, to decreased smoothness in running of the engine, above the middle rpm range of a given engine.

OBJECT AND SUMMARY OF THE INVENTION

The primary object of the present invention is to substantially reduce the roughness during operation of an internal combustion engine beyond the middle rpm range. This object is attained according to the invention by providing that the characteristic curve has a substantially reduced slope beyond that range.

Other objects and advantages of the present invention will become apparent from the ensuing specification and claims when read in conjunction with the attached drawing.

BRIEF DESCRIPTION OF THE DRAWING

FIG. 1 is a schematic view of a fuel injection pump with an injection timing cycle adjustment device;

FIG. 2 is a graph depicting the injection timing adjustment against varying rpm levels; and FIG. 3 is a detailed sectional view of the injection timing adjustment device.

DESCRIPTION OF THE PREFERRED EMBODIMENT

Turning now to FIG. 1, there will be seen a schematic representation of a fuel injection pump according to the invention. A pump piston 3 operates with a reciprocating and rotating motion simultaneously against the force of a return spring, not shown, within a cylinder bore 2 of a housing 1. The working chamber 4 of this pump is supplied with fuel from a suction chamber 7, via longitudinal grooves 5 located in the skirt of the pump piston 3 and a communicating duct 6 within the housing 1, during the suction stroke of the pump piston, that is, the travel from TDC to BDC on each stroke of the piston. As soon as the duct 6 is closed, early in the pressure stroke of the piston, by a corresponding rotation of the pump piston, the fuel located in the pump working chamber 4 is conducted into an axial channel 8 within the pump piston. From the axial channel 8, the fuel is further conducted via a branching radial bore 9 indicated by dashed lines and a longitudinal distributing groove 10 (also indicated by dashed lines) in the skirt of the pump piston to one of the pressure lines 11. The number of pressure lines 11 corresponds to the number of engine cylinders to be supplied. The pressure lines 11 are correspondingly distributed peripherally of the cylinder bore 2, and each pressure line 11 is provided with a return check valve 12 which opens in the direction of, and in response to, the fuel delivery. The suction chamber 7 is supplied with fuel from a fuel tank 14 by means of a fuel pump 13. The pump 13 is driven at an rpm proportional to the engine rpm and comprises a volumetric pump, so that the fuel pump output quantity increases with an increasing rpm level.

A ring slide 16 surrounds a portion of the pump piston 3 such that during the pressure stroke of the pump piston, a radial bore 17 connected with the axial channel 8 is opened to communicate with the suction chamber 7, thus terminating the fuel feed and determining the fuel quantity delivered by the pump piston into the pressure lines 11. The fuel still being fed, toward the end of the pressure stroke and after the opening of the radial duct 17, flows back into the suction chamber 7.

The ring slide 16 is axially displaceable by means of an intermediate lever 18 pivotable about a shaft 19 positively mounted in the housing 1. At one extremity, the intermediate lever 18 engages a lateral recess 21 in the ring slide 16 by means of a head 20. A centrifugal regulator, not shown, serves as an rpm signal source and acts on the other extremity of the intermediate lever 18. Further acting on this intermediate lever 18, in opposition to the centrifugal force, is a spring (not shown) whose pre-loading is arbitrarily variable.

Thus, the quantity of fuel injected into the pressure lines is determined by the axial position of the ring slide 16, and therefore is dependent upon the rpm level as well as upon the arbitrarily set pre-loading of the spring.

The pumping and distributing piston 3 is connected by means of a pin 23 to a disc 24 on whose bottom surface are disposed cams 25. The disc 24 is positively connected to a drive shaft 26 and is driven at an rpm in synchronization with that of the engine rpm. The cams 25 of the disc 24 cooperate with the rollers 27 of a roller rim 28 in such a manner that the pumping and distributing piston 3 executes several reciprocal movements during a single rotation of the disc. The number of the cams 25 is chosen so that the pumping and distributing piston executes as many working strokes or cycles during one rotation of the disc as there are cylinders in the given internal combustion engine to be supplied by the injection pump. The roller rim 28 is mounted in the housing 1 so as to be rotationally adjustable. Furthermore, the roller rim is connected by means of a shaft extension 29 to an injection timing adjustment piston 30, so that a displacement of the injection timing adjustment piston 30 imparts a rotational movement to the roller rim 28. In this manner, the position of the rollers 27 relative to the cams 25 may be changed so that the initial occurrence of fuel feed and, consequently, the pressure stroke of the pump piston 3, are varied relative to the rotational angle of the drive shaft 26. The result is a change in the initial injection timing point.

The injection timing adjustment piston 30 is displaced by the force of the fuel pressure prevailing in the suction chamber 7, which acts thereon via a duct 31 communicating with a chamber 32 in which the piston 30 operates. The piston 30 is displaced, by a greater or lesser amount, against the force of at least one return spring 33, dependent upon the magnitude of the fuel pressure prevailing in the suction chamber 7, thus resulting in each case in a corresponding change in the initial timing of the injection.

Further, and in accordance with the embodiment of the invention shown in FIG. 3 and discussed in detail below, two springs, each having different engagement points, are provided for the return of the piston. The chamber 34 containing the springs is connected by means of a relief duct 35 with the fuel container 14, or alternatively, with the suction line 36 running to the fuel pump 13. The control of the pressure in the pump suction chamber 7 takes place by means of a pressure control valve. This pressure control valve 38 includes a piston 39 which is displaced against a return spring 40 through the force of the fed fuel, so that the piston 39 opens a discharge bypass opening 41 more or less, dependent upon fuel pressure. A return flow duct 42 leads from the discharge opening 41 to the suction line 36 of the feed pump 13. The feed pump 13 in turn, is connected to a pressure line 43 leading into the suction chamber 7. A control line 44 branching off from the pressure line 43 leads to the pressure control valve 38.

In the graph shown in FIG. 2, the injection timing adjustment angle $\alpha$ is plotted along the ordinate and the rpm level "n" is plotted along the abscissa. The term injection timing adjustment angle should be understood to mean the relative angle of rotational shift between the drive shaft and the piston drive, that is, the rotational position of the roller rim 28. The rpm level "n" is the pump rpm, which is proportional to the engine rpm. Thus, according to the invention, a certain angle $\alpha_1$ of injection timing adjustment shall have been reached by rpm level $n_1$, that is, up to a mid-range rpm level which will differ according to the given type of engine. Beyond this rpm level, the degree of initial injection timing should decrease; that is, the characteristic curve V shall have a lower slope beyond this rpm level.

Turning now to FIG. 3, there is depicted an enlarged detailed schematic view of the injection timing cycle modulator of FIG. 1. A spring 46, disposed about a rod 47, is coaxially located relative to the spring 33. The rod 47 is secured in boss 48 of a cap 49 positively mounted in the housing 1. The rod 47 serves as a guide for a sleeve 50 disposed between the piston 30 and the spring 46. Shims 51 are installed between the spring 46 and the cap 49 to adjust the position of the sleeve 50 for a given engine and to set a desired mid-range rpm level for adjustment of injection timing.

As soon as the pressure in the suction chamber 7 of the injection pump rises, subsequent to the starting of the internal combustion engine, the piston 30 is displaced against the spring 33 as the rpm level increases. When a mid-range rpm level $n_1$ is reached, the piston has traversed the distance "h", and it comes into contact with the sleeve 50, so that, upon a further rise of the fuel pressure, the spring 46 comes into opposition to the piston travel, in addition to the spring 33. This dual opposition results in a decrease of the amount of the amount of injection timing advance with respect to any change in the rpm which remains proportional and linear; thus, the characteristic curve of the injection timing adjustment takes a lower slope beyond this rpm level. As noted above, the stroke "h" is pre-set and adjustable, according to the requirements of the given internal combustion engine, by varying the number of the shims 51. The purpose of the rod 47 is to ensure that the spring 46 is smoothly guided, and is evenly engaged by the sleeve 50, despite the often violent shaking and vibrating experienced by the engine and the vehicle in which it is employed.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump which includes a housing defining a cylindrical bore containing and guiding a pump piston connected to means for causing the simultaneous rotation and reciprocation of said pump piston, and which further includes adjusting means for causing reciprocation of said piston, said adjusting means being subject to fluid pressure, said fluid pressure being a function of engine speed, and wherein the improvement comprises:

said adjusting means includes:

a cylinder and an adjusting piston guided within said cylinder; a first spring disposed in said cylinder so as to oppose the movement of said adjusting piston in one direction of motion thereof;

a second spring, disposed in said cylinder so as to come into engagement with said piston at a different point in said cylinder from said first spring and after said piston has moved a given distance against the force of said first spring; and a pin mounted in said housing to provide axial support for said second spring.

2. A fuel injection pump as defined by claim 1, including means for changing said given distance.

3. A fuel injection pump as defined by claim 1, wherein said pin is press-fit in a hole in said housing.

4. A fuel injection pump as defined by claim 1, further comprising a sleeve guided coaxially by said pin and moving externally thereof, said sleeve being interposed between said adjusting piston and said second spring and serving to transmit forces between said adjusting piston and said second spring.

5. A fuel injection pump as defined by claim 4, wherein said pin is press-fit in a hole in said housing.

* * * * *